US009140036B2

(12) United States Patent
Tan

(10) Patent No.: US 9,140,036 B2
(45) Date of Patent: Sep. 22, 2015

(54) BAG CONTAINER DISPENSER RACK

(71) Applicant: Daniel Brian Tan, Harahan, LA (US)

(72) Inventor: Daniel Brian Tan, Harahan, LA (US)

( * ) Notice: Subject to any disclaimer, the term of this patent is extended or adjusted under 35 U.S.C. 154(b) by 34 days.

(21) Appl. No.: 14/322,619

(22) Filed: Jul. 2, 2014

(65) Prior Publication Data

US 2014/0311998 A1 Oct. 23, 2014

Related U.S. Application Data

(63) Continuation of application No. PCT/US2011/067979, filed on Dec. 29, 2011.

(51) Int. Cl.

| | |
|---|---|
| ***A47F 7/00*** | (2006.01) |
| ***E05B 67/38*** | (2006.01) |
| ***A47F 5/00*** | (2006.01) |
| ***A47F 9/04*** | (2006.01) |
| *A47F 5/01* | (2006.01) |

(52) U.S. Cl.

CPC ..... *E05B 67/38* (2013.01); *A47F 5/0037* (2013.01); *A47F 9/042* (2013.01); *A47F 5/01* (2013.01)

(58) Field of Classification Search

CPC ..... A47F 9/042; A47F 7/0014; A47F 7/0007; A47F 10/20; A47F 10/185; A47F 1/082; A47F 5/01; A47F 5/0037; A47F 5/08; B65B 43/14; A47K 10/20; A47K 10/185; B65H 35/0006

USPC ..... 211/12, 16, 45, 47, 85.15, 85.17, 96, 211/99, 106, 119, 170, 181.1; 221/47, 61, 221/62, 63; 248/95, 97, 121, 128, 133, 139, 248/153

See application file for complete search history.

(56) References Cited

U.S. PATENT DOCUMENTS

| | | | | |
|---|---|---|---|---|
| 1,159,821 | A * | 11/1915 | Barger | 248/315 |
| 1,217,682 | A | 2/1917 | Baldwin | |
| 1,218,142 | A * | 3/1917 | Weyland | 211/53 |
| 1,350,874 | A * | 8/1920 | Einar | 211/51 |

(Continued)

FOREIGN PATENT DOCUMENTS

| | | |
|---|---|---|
| JP | 08-215098 | 8/1996 |

OTHER PUBLICATIONS

International report on patentability for corresponding International application No. PCT/US11/67979 mailed Feb. 19, 2013.

(Continued)

*Primary Examiner* — Stanton L Krycinski

(74) *Attorney, Agent, or Firm* — David A. Belasco; Belasco Jacobs & Townsley, LLP

(57) ABSTRACT

A bag container dispenser rack includes a containment structure that has an open first end and an opposite, second end. The structure is sized and shaped to fit slidably about a container dispenser for film bags and has an aperture at the second end. The aperture is sized, shaped and located to at least partially align with a dispensing opening in the container dispenser. A support stand is attached to the containment structure and provides connection to a surface. The support stand is pivotally mounted to an underside of the structure and optionally is securable in either a first, upper position or a second, lower position. A latch prevents unwanted removal of the dispenser from the rack. Two or more structures may be attached to the support stand, thereby providing a choice of bags. Openings are provided in the rack to provide visual access to outer surfaces of the dispenser.

10 Claims, 3 Drawing Sheets

(56) References Cited

U.S. PATENT DOCUMENTS

| | | | | | |
|---|---|---|---|---|---|
| 1,724,428 | A | | 8/1929 | Sherman | |
| 1,883,008 | A | * | 10/1932 | Sherman | 221/46 |
| 2,223,094 | A | * | 11/1940 | Burnette | 221/46 |
| 2,327,878 | A | * | 8/1943 | Ezrol | 206/395 |
| 2,451,281 | A | * | 10/1948 | Elfner | 248/302 |
| 2,460,906 | A | * | 2/1949 | Schmiedeberg | 248/302 |
| 2,470,890 | A | * | 5/1949 | Goodpasture | 248/302 |
| 3,089,597 | A | * | 5/1963 | Kaplan | 224/400 |
| 3,096,883 | A | | 7/1963 | Llewellyn | |
| 3,160,438 | A | * | 12/1964 | Davis | 297/188.12 |
| 3,233,777 | A | | 2/1966 | Farha | |
| 3,265,246 | A | | 8/1966 | Messenger | |
| 3,313,513 | A | * | 4/1967 | Howell | 248/441.1 |
| 3,406,818 | A | | 10/1968 | Barnett | |
| 3,489,385 | A | * | 1/1970 | Dill, Jr. | 248/311.2 |
| 3,591,120 | A | * | 7/1971 | Fietzer et al. | 248/311.3 |
| 3,733,044 | A | | 5/1973 | Rabner | |
| 3,850,302 | A | * | 11/1974 | Cohen | 211/88.01 |
| 4,267,997 | A | * | 5/1981 | Meier | 220/491 |
| 4,476,996 | A | * | 10/1984 | Moore et al. | 221/61 |
| 4,580,696 | A | * | 4/1986 | Moore et al. | 221/61 |
| 4,697,776 | A | * | 10/1987 | Edson | 248/311.2 |
| 5,099,993 | A | * | 3/1992 | Lewington et al. | 206/409 |
| 5,197,705 | A | | 3/1993 | Baskas | |
| 5,240,108 | A | * | 8/1993 | Tonna | 206/366 |
| 5,332,097 | A | | 7/1994 | Wile | |
| 5,695,065 | A | | 12/1997 | Kennedy | |
| 5,950,863 | A | | 9/1999 | Schutz | |
| 6,073,899 | A | | 6/2000 | Omrani | |
| 6,102,218 | A | * | 8/2000 | Alfonso et al. | 211/119 |
| 6,250,482 | B1 | * | 6/2001 | Want et al. | 211/181.1 |
| 6,557,723 | B2 | | 5/2003 | Chen | |
| 6,758,355 | B2 | * | 7/2004 | Zidek | 211/205 |
| 7,004,435 | B2 | * | 2/2006 | Formon | 248/200 |
| 7,185,865 | B1 | * | 3/2007 | Patrick | 248/318 |
| 7,481,393 | B2 | | 1/2009 | Trinko | |
| 7,648,045 | B2 | * | 1/2010 | Christensen et al. | 221/53 |
| 7,850,014 | B2 | * | 12/2010 | Nguyen et al. | 211/12 |
| 8,444,008 | B2 | * | 5/2013 | Al-Mahnna | 221/46 |
| 8,608,023 | B2 | * | 12/2013 | Case et al. | 221/63 |
| 2002/0113182 | A1 | * | 8/2002 | Boghosian | 248/219.1 |
| 2002/0139705 | A1 | * | 10/2002 | Hajianpour | 206/494 |
| 2004/0206768 | A1 | * | 10/2004 | Tramontina et al. | 221/46 |
| 2005/0035135 | A1 | * | 2/2005 | Sasian | 221/70 |
| 2008/0053929 | A1 | | 3/2008 | Nguyen | |
| 2011/0315707 | A1 | * | 12/2011 | Kleinhuber | 221/155 |

OTHER PUBLICATIONS

International search report in corresponding International application No. PCT/US2011/067979 mailed Sep. 26, 2012.

* cited by examiner

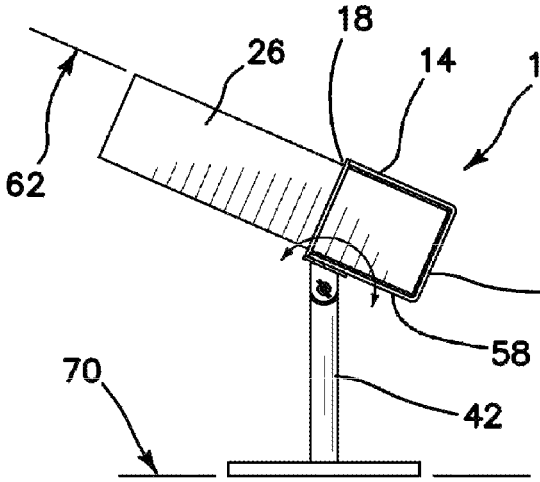
FIG. 3
FIG. 4
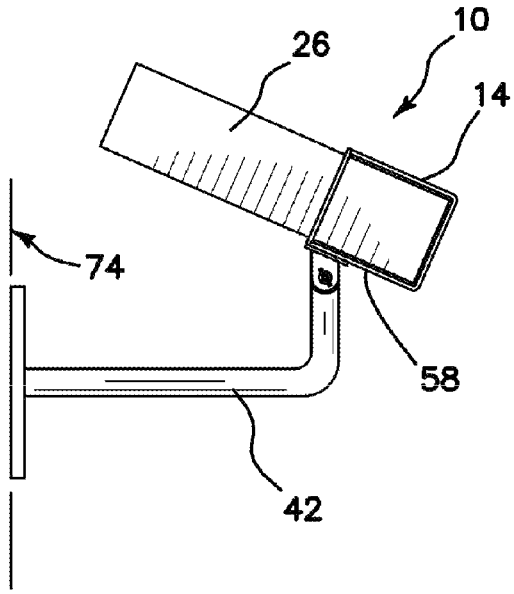
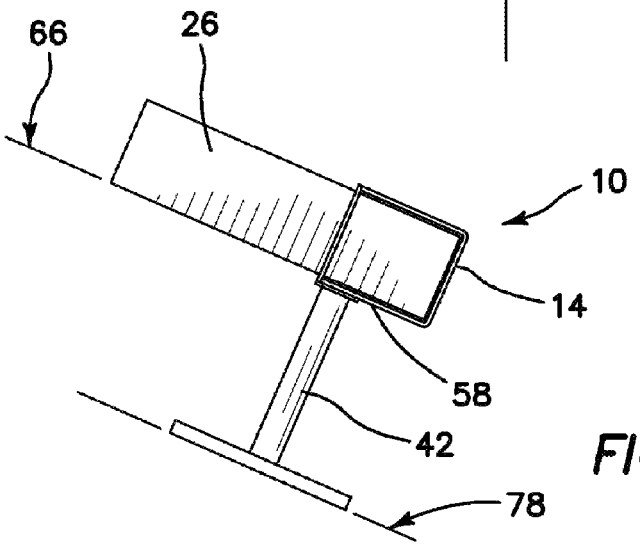
FIG. 5

BAG CONTAINER DISPENSER RACK

RELATED APPLICATION

The instant application is a continuation of PCT Application Serial No. PCT/US2012/067979 filed on Dec. 29, 2011 and claims priority to the filing date thereof.

FIELD OF INVENTION

This invention relates to the field of plastic and other film bags and disposable container dispensing systems and racks designed to utilize them.

BACKGROUND OF THE INVENTION

As counter space is usually at a premium in supermarkets and grocery stores, it is desirable to have bag dispensing systems that use a minimum of such space, are adaptable to a variety of dispenser mounting systems and provide means for keeping bags neat and orderly in the store. For most bag dispensing systems, other than roll mounted bag systems, the bags are acquired in bag packs in which a quantity of bags are adhered together for later dispensing. Typically these bag packs are packed in boxes for shipping and the bag packs must be removed from the boxes and then mounted on dispensing racks. The racks are typically installed in fixed locations. After the dispensers are loaded, the shipping containers must then be removed from the workplace. One of the advantages of rack-type dispensing systems is that, through a variety of technologies, the bags can be made to self open when withdrawn from the dispensing rack. This makes loading the bags easier for the user. A variety of systems have been developed to provide self opening film bags for supermarket or grocery use. Some dispensing systems have been developed that use the container in which the bags are provided as a dispenser. The present invention relates to racks designed to hold and display such container based dispensing systems. Some examples of the prior art include the following.

U.S. Pat. No. 5,197,705, issued to Baskas et al., discloses a holder for a box dispenser comprising an L-shape member with a shelf for receiving the box as well as an upstanding wall portion on which a clip may be mounted. The clip is spring-biased in order to hold the box in place in a preferred orientation. The bracket or holder may be secured to a vertical wall utilizing screws or fasteners through mounting openings. The dispenser is held to the front of the bracket utilizing a holding portion which may be removed for easy replacement of the dispenser.

U.S. Pat. No. 3,265,246, issued to Messenger is directed to a dispensing and display device. A carton, which may be made of paper board or fiber board, is held by means of rack. The rack is held in place by a hook-like member and extends to a dispensing section which holds the carton in place. The rack is preferably formed of metal wire or metal rods and holds the dispensing carton in place as desired U.S. Pat. No. 1,724,428, issued to Sherman illustrates a holder for paper towels and the like and is of wire frame construction. The holder may be shaped to hold a carton.

U.S. Pat. No. 3,096,883, issued to Llewellyn, is directed to a paper roll dispenser in which the rack or holder is made from a wire material and configured to support a box or carton of any desirable shape.

U.S. Patent Application No. 2009/0071924, published for Decker et al. discloses a mounting bracket for a container includes a skeletal frame work of wires forming a structure configured to removably receive a container.

U.S. Pat. No. 6,073,899, issued to Bateman is directed to a bag dispenser which is formed from a planar sheet of material wherein a portion of the sheet is cut to form a bendable flap that assists in supporting the flexible bags held within.

U.S. Pat. No. 3,738,482, issued to Omrani discloses a universal tissue box hanger which is designed with two portions so that a dispenser or box, when placed in position may be held securely by a second flat strap section which is attached to first strap section after the carton is in place. The bracket is held to the hanger and may be held to a headboard by means of a hook portion.

It is an objective of the present invention to provide a support rack for a bag dispensing system that uses the containers or boxes in which the bags are provided as a dispenser. It is a further objective to provide a support rack that allows for convenient placement of the dispensing system in a location in which space is at a premium. It is a still further objective of the invention to provide a support rack that is easily loaded and is easy to keep clean. It is yet a further objective to provide such a support rack that can be used with a variety of different mountings. Further, it is an objective of the present invention to provide a support rack that allows for maximum visibility of display graphics on the dispensing container. Finally, it is an objective to provide a support rack that is durable, inexpensive and simple to use.

While some of the objectives of the present invention are disclosed in the prior art, none of the inventions found include all of the requirements identified.

SUMMARY OF THE INVENTION

The present invention addresses all of the deficiencies of prior art dispensers for self opening film bags and satisfies all of the objectives described above.

(1) A bag container dispenser rack providing the desired features may be constructed from the following components. A containment structure is provided. The structure has an open first end and an opposite, second end. The structure is sized and shaped to fit slidably about a container dispenser for stacked film bags. The structure constrains top, bottom, first side, second side and front surfaces of the container.

(2) In a variant of the invention, the structure has an aperture at the second end. The aperture is sized, shaped and located to at least partially align with a dispensing opening in the container dispenser.

(3) In another variant, a support stand is provided. The stand is attached to the containment structure and provides connection of the structure to a surface.

(4) In a further variant of the invention, the structure is of wireframe construction.

(5) In yet a further variant, the aperture provides access to at least one surface of the container dispenser.

(6) In still another variant, the support stand is pivotally mounted to an underside of the structure.

(7) In yet another variant, the structure is securable in either a first, upper position or a second, lower position.

(8) In a further variant, the support stand is configured to attach to a horizontal surface.

(9) In yet a further variant, the support stand is configured to attach to a vertical surface.

(10) In still a further variant, the support stand is configured to attach to an angled surface.

(11) In another variant of the invention, the support stand is attached to the structure with the second end located below the first end.

(12) In still another variant, a latch is provided. The latch prevents unwanted removal of the container dispenser from the rack.

(13) In yet another variant, two or more structures are attached to the support stand, thereby providing a choice of bags.

(14) In a final variant, openings are provided in the rack to provide visual access to outer surfaces of the container dispenser for film bags.

An appreciation of the other aims and objectives of the present invention and an understanding of it may be achieved by referring to the accompanying drawings and the detailed description of a preferred embodiment.

DESCRIPTION OF THE DRAWINGS

FIG. 3 is a side elevational view of the FIG. 1 embodiment, illustrating the pivotal mounting of the dispenser to a support stand on a horizontal surface;

FIG. 4 is a side elevational view of the FIG. 1 embodiment, illustrating the pivotal mounting of the dispenser to a support stand on a vertical surface;

FIG. 5 is a side elevational view of the FIG. 1 embodiment, illustrating the pivotal mounting of the dispenser to a support stand on a angled surface;

DETAILED DESCRIPTION OF THE PREFERRED EMBODIMENT (1) FIGS. 1-6 illustrate a bag container dispenser rack 10 providing the desired features that may be constructed from the following components. As illustrated in FIG. 1, containment structure 14 is provided. The structure 14 has an open first end 18 and an opposite, second end 22. The structure 14 is sized and shaped to fit slidably about a container dispenser 26 for stacked film bags 30. The structure 14 constrains top 16, bottom 20, first side 24, second side 28 and front 32 surfaces of the container 26.

Figure 1:
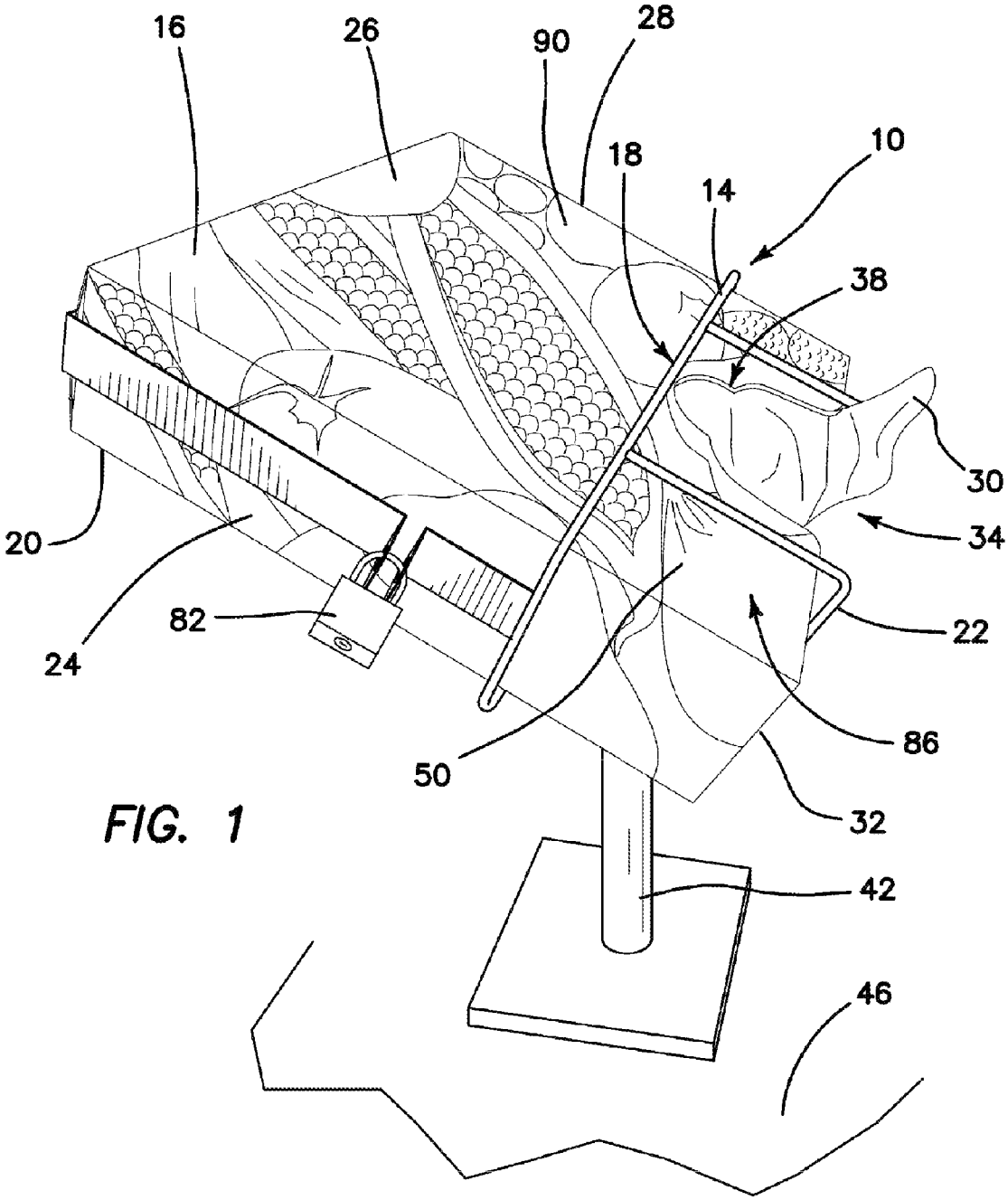
FIG. 1 is a perspective view of the preferred embodiment of the invention illustrating a bag partially withdrawn from a dispenser container held in the dispensing rack.
Figure 2:
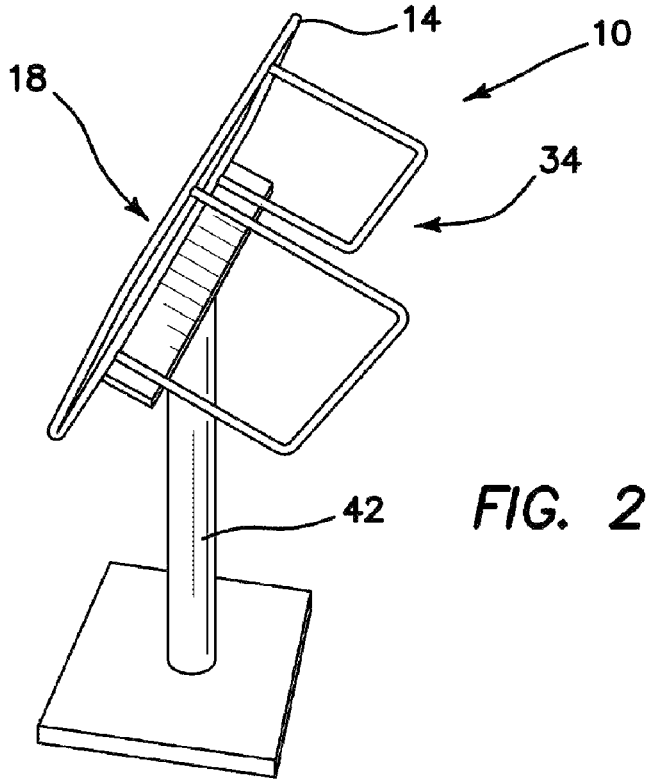
FIG. 2 is a perspective view of the FIG. 1 embodiment without a dispensing container in place.

(2) In a variant of the invention, the structure 14 has an aperture 34 at the second end 22. The aperture 34 is sized, shaped and located to at least partially align with a dispensing opening 38 in the container dispenser 26.

(3) In another variant, a support stand 42 is provided. The stand 42 is attached to the containment structure 14 and provides connection of the structure 14 to a surface 46.

(4) In a further variant of the invention, the structure 14 is of wireframe construction.

(5) In yet a further variant, the aperture 34 provides access to at least one surface 50 of the container dispenser 26.

(6) In still another variant, as illustrated in FIGS. 3 and 4, the support stand 42 is pivotally mounted to an underside 58 of the structure 14.

(7) In yet another variant, as illustrated in FIGS. 3 and 5, the structure 14 is securable in either a first, upper position 62 or a second, lower position 66.

(8) In a further variant, as illustrated in FIG. 3, the support stand 42 is configured to attach to a horizontal surface 70.

(9) In yet a further variant, as illustrated in FIG. 4, the support stand 42 is configured to attach to a vertical surface 74.

(10) In still a further variant, as illustrated in FIG. 5, the support stand 42 is configured to attach to an angled surface 78.

(11) In another variant of the invention, as illustrated in FIG. 3, the support stand 42 is attached to the structure 14 with the second end 22 located below the first end 18.

(12) In still another variant, as illustrated in FIG. 1, a latch 82 is provided. The latch 82 prevents unwanted removal of the container dispenser 26 from the rack 10.

Figure 6:
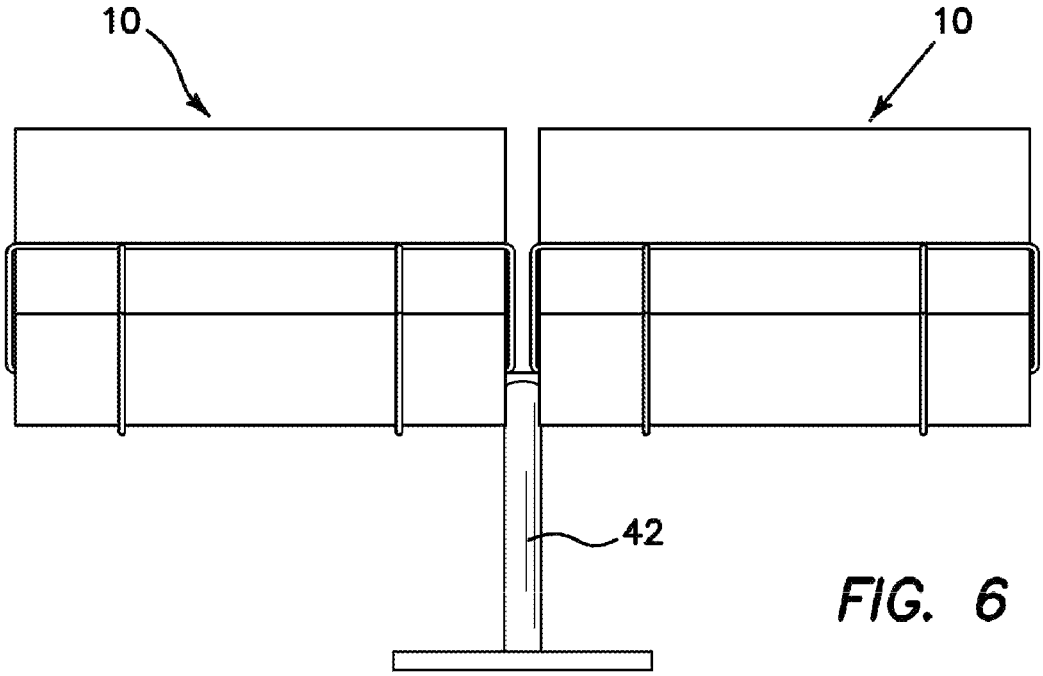
FIG. 6 is a front elevational view of two dispensers of the FIG. 1 embodiment mounted to a single support stand.

(13) In yet another variant, as illustrated in FIG. 6, two or more structures 14 are attached to the support stand 42, thereby providing a choice of bags 30.

(14) In a final variant, as illustrated in FIG. 1, openings 86 are provided in the structure 14 to provide visual access to outer surfaces 90 of the container dispenser for film bags 10.

The bag container dispenser rack 10 has been described with reference to particular embodiments. Other modifications and enhancements can be made without departing from the spirit and scope of the claims that follow.

The invention claimed is:

1. A bag container dispenser rack comprising:

a containment structure, said structure having a completely open first end and an opposite, second end;

said structure being sized and shaped to fit slidably about a container dispenser for stacked film bags;

said container dispenser being configured to be slid through said open first end;

said structure simultaneously constraining top, bottom, first side, second side and front surfaces of said container dispenser;

said structure having an aperture at said second end, said aperture being sized, shaped and disposed to at least partially align with a dispensing opening in said top and said front surfaces of said container dispenser;

a support stand, said stand being attached to said containment structure and providing connection of said structure to a surface;

said support stand being pivotally mounted to an underside of said structure; and said structure being of wireframe construction.

2. The bag container dispenser rack, as described in claim 1, wherein said aperture provides access to at least one surface of said container dispenser.

3. The bag container dispenser rack, as described in claim 1, wherein said structure is securable relative to said stand in either of a first, upper position and a second, lower position.

4. The bag container dispenser rack, as described in claim 1, wherein said support stand is configured to attach to a horizontal surface.

5. The bag container dispenser rack, as described in claim 1, wherein said support stand is configured to attach to a vertical surface.

6. The bag container dispenser rack, as described in claim 1, wherein said support stand is configured to attach to an angled surface.

7. The bag container dispenser rack, as described in claim 1, wherein said support stand is attached to said structure with said second end disposed below said first end.

8. The bag container dispenser rack, as described in claim 1, further comprising a latch, said latch preventing unwanted removal of said container dispenser from said rack.

9. The bag container dispenser rack, as described in claim 1, wherein two or more of said structure are attached to said support stand, thereby providing a choice of bags.

10. The bag container dispenser rack, as described in claim 1, wherein openings are provided in said rack to provide visual access to outer surfaces of said container dispenser for film bags.

* * * * *